United States Patent [19]

Perkins

[11] Patent Number: 4,620,592

[45] Date of Patent: Nov. 4, 1986

[54] PROGRESSIVE SEQUENCE FOR VISCOUS OIL RECOVERY

[75] Inventor: Thomas K. Perkins, Dallas, Tex.

[73] Assignee: Atlantic Richfield Company, Los Angeles, Calif.

[21] Appl. No.: 619,470

[22] Filed: Jun. 11, 1984

[51] Int. Cl.[4] ..... E21B 43/24; E21B 43/30

[52] U.S. Cl. ..... 166/245; 166/248; 166/263; 166/272

[58] Field of Search ..... 166/245, 248, 263, 268, 166/272

[56] References Cited

U.S. PATENT DOCUMENTS

| | | | |
|---|---|---|---|
| 3,547,193 | 12/1970 | Gill | 166/248 |
| 3,605,888 | 9/1971 | Crowson et al. | 166/248 |
| 3,946,809 | 3/1976 | Hagedorn | 166/248 |
| 3,948,319 | 4/1976 | Pritchett | 166/245 X |
| 4,037,655 | 7/1977 | Carpenter | 166/248 |
| 4,084,637 | 4/1978 | Todd | 166/245 |
| 4,456,065 | 6/1984 | Heim et al. | 166/248 |
| 4,489,782 | 12/1984 | Perkins | 166/248 |
| 4,499,948 | 2/1985 | Perkins | 166/248 |

*Primary Examiner*—George A. Suchfield
*Attorney, Agent, or Firm*—M. David Folzenlogen; Michael E. Martin

[57] ABSTRACT

A subterranean viscous oil bearing formation is progressively produced in a preselected direction by a combination of steps conducted in sets of wells spaced from each other in the preselected direction. A first set of wells is used to both apply electrical heat to the formation and inject brine, preferably at low rates. Then electrical heating and brine injection are applied to a second set of wells spaced in the preselected direction from the first set of wells. Electrical heating in the first of wells is ceased and hot aqueous fluid injection is commenced. These steps are moved in sequence to coact with each other and traverse and produce the formation thereby providing a more energy efficient process. Variations cover electrically stimulated huff and puff backflowing or producing steps to control wellbore resistance and distribute the heat uniformly in the proper direction. A pressure maintenance fluid may also be injected in the depleted part of the formation.

15 Claims, 1 Drawing Figure

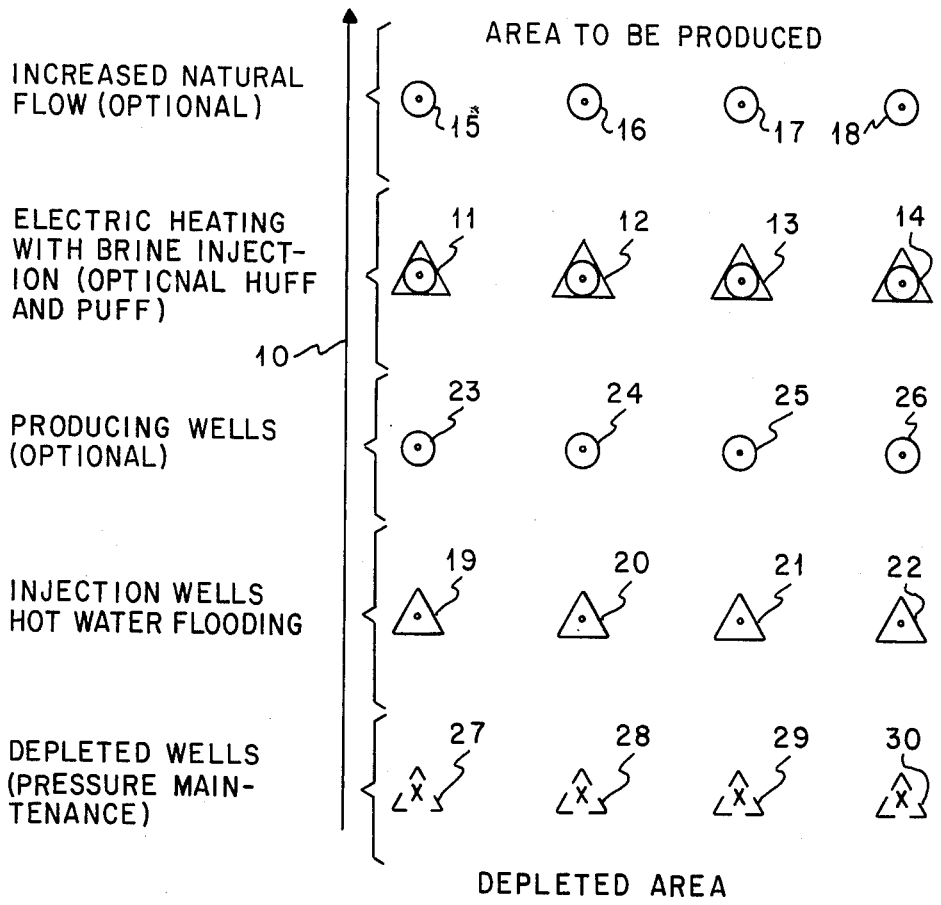
AREA TO BE PRODUCED
INCREASED NATURAL FLOW (OPTIONAL)
15
16
17
18
ELECTRIC HEATING WITH BRINE INJECTION (OPTICNAL HUFF AND PUFF)
11
12
13
14
10
PRODUCING WELLS (OPTIONAL)
23
24
25
26
INJECTION WELLS HOT WATER FLOODING
19
20
21
22
DEPLETED WELLS (PRESSURE MAINTENANCE)
27
28
29
30
DEPLETED AREA

PROGRESSIVE SEQUENCE FOR VISCOUS OIL RECOVERY

BACKGROUND OF THE INVENTION

The invention relates to a progressive sequence for producing a selected portion of a formation containing viscous oil. More particularly, wells in a series of patterns progressively extending across a segment of a formation are subjected to a combination of electrical heating with brine injection, hot water inject and production.

In the recovery of oil from viscous oil bearing formations it is usually possible to produce only a very small portion of the original in-place oil by natural or primary production which relies solely on the natural forces present in the formation. A variety of artificial recovery techniques, therefore, have been employed to increase oil recovery. The most commonly applied technique is water flooding in which water is injected at a pressure sufficient to displace oil in the reservoir toward producing wells. Water flooding has little success in displacing viscous oil which is essentially in its viscous natural state. Steam injection has been used, but steam displacement uses heat inefficiently and its use is limited. Steam soaks and huff and puff techniques have been used with and without foaming, surfactant and caustic agents, but by themselves these techniques have limited application. More recently, it has been proposed, for example, in U.S. Pat. Nos., 3,642,066; 3,874,450, 3,848,671, 3,948,319; 3,958,636; 4,010,799 and 4,084,637, to use electrical current to add heat to a subsurface pay zone containing tar sands or viscous oil to render the viscous hydrocarbons more flowable. In general, two or more electrodes are connected to an electrical power source and are positioned at spaced apart points in contact with the earth in a manner such that when electric current is passed between the electrode it will heat viscous oil in a subsurface formation. Voltages of a couple of hundred volts and up to and exceeding 1000 volts are applied to the electrodes. Currents up to 1800 amperes are passed between the electrodes. Electrical heating processes are consistent with creating temperatures that cause the most benefit, but most of the heat occurs adjacent to the electrode and heat transfer outward into the formation by conduction is slow. Moreover, the power efficiency of electrical generation is only about one-third. Brine and factures have been used to decrease electrode resistance and increase electrode radius. Moreover, it has been proposed to use the electrode wells and aqueous injection wells in well patterns based in part on the number of phases of the electricity used to apply heat to the formation. Such patterns have been used in conventional ways and their efficiency, therefore, is less than it could be.

It is the primary object of this invention to provide an electric heating, injection and production sequence that progressively produces a selected portion of a viscous oil bearing formation in an efficient and more complete manner.

SUMMARY OF THE INVENTION

A selected portion of a subterranean reservoir containing viscous oil is progressively produced by electrically heating three or more wells at power rate levels sufficient to heat the part of the formation near the electrode wells and concommitantly, brine is injected, preferably at low rates. Brine injection has several purposes and advantages. It maintains a formation pressure that avoids rapid vaporization of the formation fluids near the wells. The brine creates good electrical contact between the electrode wells and formation and a high conductivity region for the electrode. Brine injection also moves heat away from the electrode wells and deeper into the formation. In addition, the brine compresses surrounding fluids and slightly raises formation pressure. This may also increase natural flow production from wells drilled and completed in a progressive manner ahead of the electrically heated wells. The electrode-brine injection wells may have too low an injectivity for use of the electrical power, or periodically the temperature near the electrode wells might increase to a point which cause vaporization of formation fluids. Either of these events is likely to cause undesirably high electrode well resistance. In either event, brine injection may be suspended and the electrode wells backflowed to produce formation fluids at relatively high rates to control temperature or increase the volume of the effective electrode wellbore region. Alternatively, some of the electrode-brine injection wells may be selected as producers and brine injection suspended only in these wells which are then produced while the rate of brine injection into the other wells is increased. Flow from injector well to producer well controls the temperature in the electrode wellbore region and helps to distribute the heat more uniformly and away from the electrode wells in the direction desired for progressively producing oil from the subsurface formation. In both of these two alternatives of periodic production, injection and production act like a form of electrically stimulated huff and puff. After an appropriate time, electrical heating and brine injection is commenced in a new set or sets of electrode wells spaced from the original electrode wells in a direction designed to progresively produce the selected portion of the subsurface formation. Either before, after or simultaneously with commencing electrical heating and brine injection in the second set or sets of electrode wells, electrical heating and brine injection in the original electrode wells is ceased and some or all of these original wells are used as hot aqueous fluid injection wells. Thereafter, as the process progresses and hot aqueous fluid injection is no longer needed, the depleted wells may be used to inject a less expensive fluid, for example, water, to maintain pressure on the formation and prevent flow of the formation fluids or hot injected fluids back into the depleted area. Oil is produced either by the previously mentioned huff and puff steps, or through production wells appropriately located in the sequence in advance of the hot aqueous fluid injections wells. The production wells may be converted electrode-brine injection wells. The foregoing sequence is progressively repeated until oil is produced from the selected portion of the subsurface formation.

BRIEF DESCRIPTION OF THE DRAWING

The drawing is a schematical top plan view of a selected portion of a formation that is being progressively produced in accordance with the sequential method described herein.

DETAILED DESCRIPTION

This invention describes a more energy efficient, thorough, interacting sequence of steps for producing oil from a formation containing viscous oil. The process is suitable to be practiced in any formation containing viscous oil whose viscosity is susceptible to significant reduction and increased mobility at temperatures achievable by electrical formation heating with or without the addition of hot water or steam. The maximum benefits of the process apply primarily to formations where the oil has an API gravity of less than 20.

In order to prepare the formation for practice of the process, a portion or all of the formation will be selected for progressive treatment and production. Selection of the location and size of the area to be produced depends on many factors, for example, the thickness of the formation and oil mobility, familiar to reservoir and production engineers. During selection of the area to be produced, a plan for progressively developing and producing the selected portion of the formation will be developed. The plan will include direction 10 shown in the drawing in which the area is to be produced. The plan will also show the type and number of well patterns to be used and the well spacings. In the drawing, five rows of four wells each are illustrated, but it is to be understood that any form of well patterns may be used. The progressive rows or patterns may be in the form of a progressive series of different size circles, squares, triangles or other such configurations. The wells may be completed in any manner suitable for the purposes hereinafter stated, for example, in the manner set forth in co-pending application Ser. No. 509,839, filed June 30, 1983, now U.S. Pat. No. 4,484,627, entitled "Well Completion for Electrical Power Transmission", and owned by a common assignee. The wells may be completed in the formation in a manner such that the effective radius of the well exceeds the effective radius of an essentially vertical well. The increase in effective radius may be provided by drilling an enlarged borehole and gravel packing it or by one or more slanted or horizontal boreholes extending laterally into and across part of the formation. Although other conventional forms of electrodes may be used, it is expected that wells will be cased and that the electrodes and the upper part of the casing will be used as an electric conductor in wells that are electrically heated. In order to reduce the magnetic hysteresis losses if alternating currrent is used, the upper part of the casing may be comprised of a non-magnetic metal, such as, for example, stainless steel or aluminum. Corrosion and premature loss of power to the overburden or underburden may be prevented by electrically insulating the exterior of the casing with cement, coatings, pipe wrapping, extruded plastic, heat shrinkable sleeves, or other similar insulating or nonconductive corrosion protection materials.

Electric voltage from a suitable power source, for example, pulsating DC, or single or polyphase eccentric or regular AC of any suitable number of cycles per second will be applied to some of the wells. Polyphase eccentric or regular alternating current is much preferred for its greater efficiency. Switches and voltage control means will be used to control application, duration and magnitude of the voltage or current flowed between electrodes and passed through the formation. For this invention it is preferred that the power generator be operated directly or indirectly by burning a combustible fuel material. Any type of combustible material may be burned, but the fuel will generally be some material readily available in the producing area, for example, methane, heavy oil or coal. Typically, electric power is generated in three ways that produce hot exhaust flue gases. For example, a combustible fuel may be mixed with air and burned or combusted in an engine or turbine which drives a generator. The hot exhaust flue gas may then be heat exchanged with water to produce hot water or steam. Another method of generating electricity and producing hot injection water or steam is to burn air and fuel and use the hot flue gas to heat a compressed turbine gas and to heat water by heat exchange with both the turbine gas and water. Still another method is to compress the air to an elevated pressure and burn the fuel with the high pressure air. The hot high pressure flue gas is then expanded through the compressor and thereafter used to heat the water to hot water or steam. Electrical voltages varying from a few hundred volts to 1000 or more will be applied to the electrode production and injection wells and currents from a few hundred to 1000 or more amperes will be flowed between the electrodes.

In operation, a portion of a subsurface formation containing viscous oil is selected to be progressively produced in a preselected direction from an initial point. A plurality of wells 11, 12, 13 and 14 are drilled from the surface of the earth. The wells are completed at the desired spacing and in the desired initial pattern. The wells are completed in a conventional manner to act both as electrode wells and as water injection wells. Electrical voltage is applied through wells 11, 12, 13 and 14 either to the casing or tubing or to a separately installed electrode in a manner such that electric current flows through a part of the oil-bearing portion of formation adjacent the wells. The amount of voltage and current applied is sufficient to increase the temperature of the part of the subsurface formation selected to be progressively produced. The actual temperature increase will depend on a number of conditions. The high current density immediately adjacent the wells causes a rapid temperature increase in the area of the wells. The heat and electric power consumption are moved outwardly away from the electrode-brine injection wells in a preselected direction designed to produce the formation toward a point where a second group of wells 15, 16, 17 and 18 are to be completed as hereinafter described. The temperature in the formation midway between wells 11, 12, 13 and 14 and wells 15, 16, 17 and 18 will generally be increased about 10° to 50° F. At the same time as electric current is being passed into the formation, salt water, sea water or brine is injected into the wells and into the subsurface formation. The brine may or may not have been preheated. Preheating is preferred if a ready source of excess heat is available, for example, hot exhaust gases from electrical power generation. The brine is injected at relatively low rates selected to maintain sufficient formation pressure, for example, 25 to 2000 psi, to prevent excessive vaporization of the heated formation fluids. The brine also creates good electrical contact between the electrodes and the oil-bearing formation. The brine also moves heat away from the wellbore and deeper into the formation. This creates a large high conductivity region for the electrodes. The heated fluids flow readily away from the electrode-brine injection wells compressing surrounding fluids and raising the formation pressure.

The injectivity of the electrode-injection wells may be undesirably low. Or periodically, the electrodes might get sufficiently hot to cause vaporization of formation fluids despite brine injection. This may lead to undesirably high wellbore resistance. In either case, brine injection may be suspended into wells 11, 12, 13 and 14 and the wells backflowed to produce fluids from the subsurface formation. Thereafter, brine injection may be reinstituted into the wells. Alternatively, brine injection into less than all of wells 11, 12, 13 and 14 may be suspended while brine is injected at an increased rate into the remaining wells. For example, brine injection could be suspended in wells 11 and 13 and brine injected at a higher rate into wells 12 and 14. Fluids are backflowed and produced from the wells (e.g. wells 11 and 13) into which brine injection is suspended. If desired, the temporary producing and higher rate injection wells may be switched one or more times. The high rate of injection of the brine cools the formation adjacent the electrode wells and forces fluids out the temporary producing wells. This also aids in distributing the heat into the selected portion of the formation in advance of the electrical heating-brine injection wells. Thereafter, brine injection into all of the wells will be reinstituted. The huff and puff action of temporarily suspending brine injection and backflowing or producing the wells and reinstituting brine injection is electrically stimulated by the electric current applied to the formation. These two alternatives are hereinafter referred to as electrical huff and puff. As hereinafter mentioned in connection with a hot water injection step, this electrical huff and puff action may also be used to produce oil displaced by hot aqueous fluid injection into other wells.

While a portion of the subsurface formation is being heated by the electrode-brine injection wells, a second set of wells may optionally be produced by essentially natural flow. Accordingly, wells 15, 16, 17 and 18 are spaced from wells 11, 12, 13 and 14 in a direction selected to progressively traverse the portion of the subsurface formation to be produced. Advance oil production reduces the formation pressure in the area of wells 15, 16, 17 and 18 and assists the next step of the process of this invention.

At a preselected point based on the design of the progressive production plan, electrical heating through wells 11, 12, 13 and 14 is discontinued. For example, electrical heating in these wells may be discontinued when the temperature of the formation midway between wells 11, 12, 13 and 14 and wells 15, 16, 17 and 18 is raised 10° to 50° F. It is estimated that for twenty acre spacing electrical heating and brine injection into a set of wells will be conducted for one year and longer. At an economical and appropriate point, for example, shortly before or after discontinuance of electrical heating in wells 11, 12, 13 and 14, electrical voltage is applied through wells 15, 16, 17 and 18 either to the casing or tubing or to a separately installed electrode in a manner such that electric current is passed through a part of the formation adjacent these wells. The amount of voltage and current is sufficient to increase the temperature of a part of the subsurface oil-bearing formation selected to be progressively produced. At the same time, salt water, sea water or brine is injected into the wells and into the subsurface formation. The brine may or may not have been preheated. The brine is injected at a relatively low rate to maintain sufficient formation pressure, for example, 25 to 2000 psi, to prevent excessive vaporization of the heated formation fluids. Electrical heating and low rate brine injection in this second set of wells performs the functions previously described, but the heating is applied progressively in a direction selected and designed to traverse the portion of the subsurface formation selected for oil production and coact with the earlier electrical heating-brine injection step. If the injectivity of this second set of wells is undesirably low so the electrodes get sufficiently hot to cause vaporization of the formation fluids despite brine injection, one or both of the electrical huff and puff alternatives previously described may be practiced to decrease wellbore resistance, stop vaporization and distribute the heat more uniformly and outwardly in the direction that the formation is to be progressively produced.

After electrical heating through wells 11, 12, 13 and 14 is discontinued, hot aqueous fluid is injected into some or all of these former electrode wells. For illustrative purposes and to demonstrate the progressive and more complete producing capabilities of this invention, the hot water flooding injection wells are shown as wells 19, 20, 21 and 22. As mentioned, these wells preferably are converted electrode-brine injection wells. Hot means 120° F. or above. The aqueous fluid is injected into a part of the subsurface formation previously heated by electricity and acts both as hot buffer zone to keep the oil mobile and as a conventional displacement medium. Exemplary hot aqueous fluids are steam, heated water and polymer, heated aqueous emulsions, heated gas-water mixtures like carbon dioxide and water, and the like. For efficient results, the heat for the hot aqueous drive fluid may be obtained or recovered from hot exhaust gases or hot fluids produced during generation of electrical power for the electrode-brine injection wells which precede the hot aqueous fluid injection in the sequence of steps of this disclosure. One or more optional newly completed producing wells or converted electrode-brine injection wells 23, 24, 25, and 26 are located between the wells in which electrical heating and brine injection is being conducted and the wells which are being used as hot aqueous fluid injection wells and are used to produce oil from the subsurface formation. The hot aqueous fluid thereby displaces oil toward the optional intermediate producing well or wells. If the optional producing well or wells are not used, oil may be produced from wells 11, 12, 13 or 14 or wells 15, 16, 17 or 18 during the optional electrical huff and puff alternatives steps previously described.

The steps previously described are applied and moved sequentially across the formation in selected direction 10 to produce and deplete the subsurface viscous oil reservoir. The initial step of electrical heating-low rate brine injection with or without electrical huff and puff in the first wells is transferred to a second set of wells. The second set of wells is spaced from the first wells in the preselected direction designed to produce and deplete the reservoir. After electrical heating-brine injection is discontinued the first set of wells may be converted to producing wells, or to hot aqueous fluid flooding wells, or both. When electrical heating and low rate brine injection is moved to a third set of wells spaced in the planned direction and the hot aqueous fluid injection is moved in a progressive manner to a second set of wells, the first or original set of wells may be converted to injecting an unheated pressure maintenance fluid, preferably ordinary water flooding. The pressure maintenance fluid is thereby injected into the depleted portion of the formation. Each step of the above-described sequence is progressively moved in the preselected direction 10 to a fifth set of wells, and then a sixth set of wells, and so on, until the portion of the viscous oil bearing subsurface formation selected for production is traversed.

Many variations of the above-described progressive producing system will be apparent to persons skilled in the art without departing from the spirit and scope of the claims.

I claim:

1. A progressive method of producing oil from a portion of a subsurface formation containing viscous oil selected to be progressively produced comprising:

a. injecting brine at a first rate of injection into said selected portion of said formation through a plurality of first wells while applying electrical voltage through said plurality of first wells in a manner such that electric current flows through a part of said selected portion of said formation adjacent said plurality of first wells, said current being sufficient to increase the temperature of said part of said selected portion of said formation;

b. injecting brine at a second rate of injection into said selected portion of said formation through a plurality of second wells while applying electrical voltage through said plurality of second wells at a predetermined time after commencement of injection of brine and applying electrical voltage through said plurality of first wells in a manner such that electric current flows through a part of said selected portion of said formation adjacent said plurality of second wells, said current being sufficient to increase the temperature of said part of said selected portion of said formation, said plurality of second wells being spaced from said plurality of first wells in a first direction selected to progressively traverse said selected portion of said formation;

c. discontinuing step "a" in said plurality of first wells;

d. injecting hot aqueous fluid into said selected portion of said formation through said plurality of first wells, and e. concomitantly with step "d", producing oil from said selected portion of said formation through at least one production well, said production well being spaced in said first direction from said plurality of first wells.

2. The method of claim 1 wherein concomitantly with step "a", oil is produced from said selected portion of said formation through a plurality of production wells spaced in said direction from said plurality of first wells.

3. The method of claim 1 wherein step "a" includes suspending injection of brine into said plurality of first wells, backflowing said plurality of first wells to produce fluids from said formation, and reinstituting injection of brine into said plurality of first wells.

4. The method of claim 1 wherein step "b" includes suspending injection of brine into said plurality of second wells, backflowing said plurality of second wells to produce fluids from said formation, and reinstituting injection of brine into said plurality of second wells.

5. The method of claim 1 wherein step "a" includes suspending injection of brine into less than all of said plurality of first wells, injecting brine into the remaining wells of said plurality of first wells at an increased rate with respect to said first rate of injection, producing fluids from each well into which brine injection was suspended, and reinstituting injection of brine into said plurality of first wells.

6. The method of claim 1 wherein step "b" includes suspending injection of brine into less than all of said plurality of second wells, injecting brine into the remaining wells of said plurality of second wells at an increased rate with respect to said second rate of injection, producing fluids from said second wells into which brine injection was suspended, and reinstituting injection of brine into said plurality of second wells.

7. A progressive method of producing oil from a portion of a subsurface formation containing viscous oil selected to be progressively produced comprising:

a. injecting brine into said selected portion of said formation through a plurality of first wells while applying electrical voltage through said plurality of first wells in a manner such that electric current flows through a part of said selected portion of said formation adjacent said plurality of first wells, said current being sufficient to increase the temperature of said part of said selected portion of said formation;

b. injecting brine into said selected portion of said formation through a plurality of second wells at a predetermined time after commencement of injecting brine and applying electrical voltage through said plurality of first wells and in a manner such that electric current flows through a part of said selected portion of said formation adjacent said plurality of second wells, said current being sufficient to increase the temperature of said part of said selected portion of said formation, said plurality of second wells being spaced from said plurality of first wells in a first direction selected to progressively traverse said selected portion of said formation;

c. discontinuing step "a" in said plurality of first wells;

d. injecting hot aqueous fluid into said selected portion of said formation through said plurality of first wells, and e. concomitantly with step "d", suspending brine injection in at least one of said second wells and producing oil from said selected portion of said formation through said at least one of said second wells.

8. A progressive method of producing oil from a portion of a subsurface formation containing viscous oil selected to be progressively produced comprising:

a. injecting hot aqueous fluid into said selected portion of said formation through a plurality of first wells, and b. concomitantly with step "a", producing oil from said selected portion of said formation through a plurality of second wells, said plurality of second wells being spaced from said plurality of first wells in a first direction, said first direction being selected to progressively traverse said selected portion of said formation;

c. concomitantly with step "b", injecting brine at a first rate of injection into said selected portion of said formation through a plurality of third wells while applying electrical voltage through said plurality of third wells in a manner such that electric current flows through a part of said selected portion of said formation adjacent said plurality of third wells, said current being sufficient to increase the temperature of said part of said selected portion of said formation, said plurality of third wells being spaced from said second wells in said first direction;

d. providing a plurality of fourth wells extending into said selected portion of said formation, said plurality of fourth wells being spaced from said plurality of third wells in said first direction, transferring the electrical voltage and brine injection of step "c" to said plurality of fourth wells, transferring step "b" to said plurality of third wells, and transferring step "a" to said plurality of second wells.

9. The method of claim 8 wherein oil is produced from said selected portion of said formation through a plurality of production wells spaced in said first direction from said plurality of fourth wells.

10. The method of claim 8 wherein in step "b", the method includes suspending injection of brine into said plurality of fourth wells, backflowing said plurality of fourth wells to produce fluids from said formation, and reinstituting injection of brine into said plurality of fourth wells.

11. The method of claim 8 wherein in step "c", the method includes suspending injection of brine into less than all of said plurality of fourth wells, injecting brine into the remaining wells of said plurality of fourth wells at a second rate of injection higher than said first rate of injection, producing fluids from said wells into which brine injection was suspended, and reinstituting injection of brine into said plurality of fourth wells.

12. The method of claim 8 wherein a pressure maintenance fluid is injected into said plurality of first wells.

13. A progressive method of producing oil from a portion of a subsurface formation containing viscous oil selected to be progressively produced comprising:

a. injecting hot aqueous fluid into said selected portion of said formation through a plurality of first wells;

b. concomitantly with step "a", producing oil from said selected portion of said formation through a plurality of second wells, said plurality of second wells being spaced from said plurality of first wells in a first direction, said first direction being selected to progressively traverse said selected portion of said formation;

c. concomitantly with step "b", injecting brine into said selected portion of said formation through a plurality of third wells while applying electrical voltage through said plurality of third wells in a manner such that electric current flows through a part of said selected portion of said formation adjacent said plurality of third wells, said current being sufficient to increase the temperature of said part of said selected portion of said formation, said plurality of third wells being spaced from said second wells in said first direction;

d. suspending injection of brine into said plurality of third wells;

e. backflowing said plurality of third wells to produce fluids from said formation; and f. reinstituting injection of brine into said plurality of third wells.

14. The method of claim 13 wherein concomitantly with steps "a", "b", and "c", oil is produced from said selected portion of said formation through a plurality of production wells spaced in said first direction from said plurality of third wells.

15. A progressive method of producing oil from a portion of a subsurface formation containing viscous oil selected to be progressively produced comprising:

a. injecting hot aqueous fluid into said selected portion of said formation through a plurality of first wells;

b. concomitantly with step "a", producing oil from said selected portion of said formation through a plurality of second wells, said plurality of second wells being spaced from said plurality of first wells in a first direction, said first direction being selected to progressively traverse said selected portion of said formation;

c. concomitantly with step "b", injecting brine at a first rate of injection into said selected portion of said formation through a plurality of third wells while applying electrical voltage through said plurality of third wells in a manner such that electric current flows through a part of said selected portion of said formation adjacent said plurality of third wells, said current being sufficent to increase the temperature of said part of said selected portion of said formation, said plurality of third wells being spaced from said second wells in said first direction;

d. suspending injection of brine into said plurality of third wells;

e. injecting brine into the remaining wells of said plurality of third wells at a rate of injection greater than said first rate of injection;

f. producing fluids from said wells into which brine injection was suspended; and g. reinstituting injection of brine into said plurality of third wells.

* * * * *